US006656034B2

(12) United States Patent
Rasmussen et al.

(10) Patent No.: US 6,656,034 B2
(45) Date of Patent: Dec. 2, 2003

(54) COIN HANDLING DEVICE WITH FOLDING ESCALATOR

(75) Inventors: James M. Rasmussen, Chicago, IL (US); Gregory J. Tastad, Kenosha, WI (US); Norman R. Wurz, Des Plaines, IL (US); Erik J. Lindahl, West Bend, WI (US)

(73) Assignee: WMS Gaming Inc., Waukegan, IL (US)

( * ) Notice: Subject to any disclaimer, the term of this patent is extended or adjusted under 35 U.S.C. 154(b) by 220 days.

(21) Appl. No.: 09/990,606

(22) Filed: Nov. 21, 2001

(65) Prior Publication Data

US 2003/0096570 A1 May 22, 2003

(51) Int. Cl.[7] ..... G07D 1/00

(52) U.S. Cl. ..... 453/56; 232/56; 902/15; 198/632

(58) Field of Search ..... 453/7, 11, 33, 453/34, 56; 232/56; 902/15

(56) References Cited

U.S. PATENT DOCUMENTS

| | | | | | |
|---|---|---|---|---|---|
| 3,815,482 | A | * | 6/1974 | Nelson | 493/53 |
| 4,991,829 | A | * | 2/1991 | Fischer et al. | 271/9.02 |
| 5,520,577 | A | * | 5/1996 | Rasmussen | 453/56 |
| 5,908,351 | A | * | 6/1999 | Tanaka | 453/11 |

OTHER PUBLICATIONS

Coin Escalator Hopper, Asahi Seiko Co., Ltd., 3 pages, 1992.

* cited by examiner

*Primary Examiner*—Donald P. Walsh
*Assistant Examiner*—Kenneth W. Bower

(57) ABSTRACT

A coin handling device comprises a hopper and an escalator for receiving coins from the hopper. The escalator is connected to the hopper and extends upwardly from the hopper. At least a portion of the escalator is downwardly foldable toward the hopper to reduce an overall height of the coin handling device. The reduced height facilitates removal of the coin handling device from a gaming machine cabinet and installation of the coin handling device into the cabinet in the event the cabinet provides minimal clearance.

28 Claims, 6 Drawing Sheets

COIN HANDLING DEVICE WITH FOLDING ESCALATOR

FIELD OF THE INVENTION

The present invention relates generally to coin handling devices and, more particularly, to a coin handling device with a folding escalator.

BACKGROUND OF THE INVENTION

At the end of a gaming session on a coin-out gaming machine, a player presses a "cashout" or "collect" button and collects a number of coins corresponding to the number of credits remaining on the machine's credit meter. The gaming machine contains a coin handling device filled with coins. The coin handling device delivers the appropriate number of coins to a coin outlet and dispenses the coins into a coin tray or bin via the coin outlet. The coin handling device includes at least a coin hopper.

If, however, the coin tray is located above the hopper as in many slant-top gaming machines, the coin handling device may also include a coin escalator extending upwardly from the hopper to the coin outlet. The hopper may be mounted to the floor of the machine cabinet, while the coin tray is approximately adjacent to a button panel at a height well above the floor of the machine cabinet. The escalator successively receives coins from the hopper and conveys them upwardly in a single file to the coin outlet. It is sometimes necessary to remove the coin handling device from the cabinet for servicing or replacement. Because the escalator extends upwardly from the hopper, however, the cabinet may not provide sufficient clearance for removal and later installation of the coin handling device without tilting the device awkwardly as it is removed/installed or somehow disconnecting the escalator from the hopper prior to removal/installation. A need therefore exists for a coin handling device with escalator that facilitates removal of the device from the gaming machine cabinet and installation of the device into the cabinet.

SUMMARY OF THE INVENTION

A coin handling device comprises a hopper and an escalator for receiving coins from the hopper. The escalator is connected to the hopper and extends upwardly from the hopper. At least a portion of the escalator is downwardly foldable toward the hopper to reduce an overall height of the coin handling device. The reduced height facilitates removal of the coin handling device from a gaming machine cabinet and installation of the device into the cabinet in the event the cabinet provides minimal clearance.

BRIEF DESCRIPTION OF THE DRAWINGS

The foregoing and other advantages of the invention will become apparent upon reading the following detailed description and upon reference to the drawings.

Figure 1:
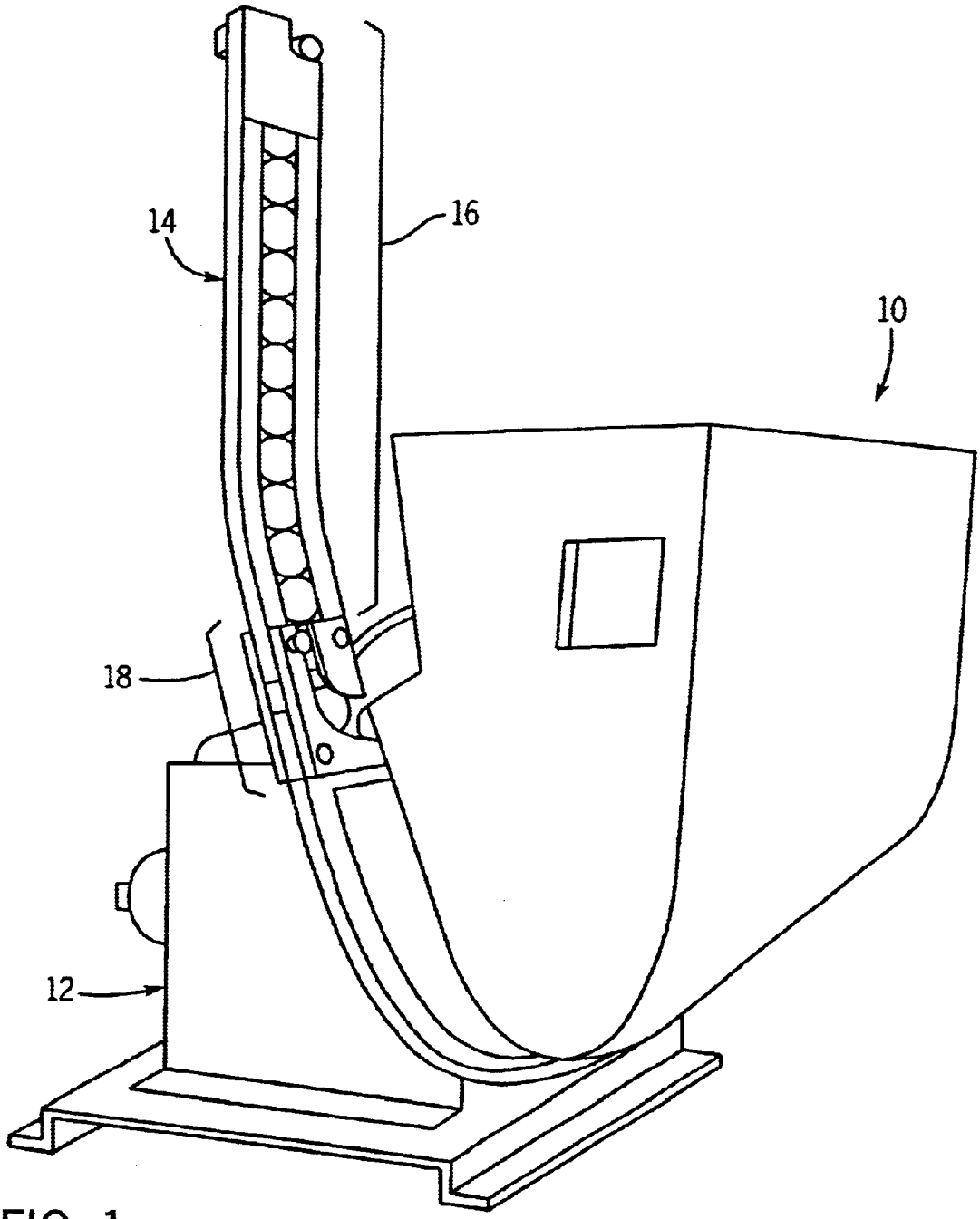
FIG. 1 is a perspective view of a coin handling device with folding escalator embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
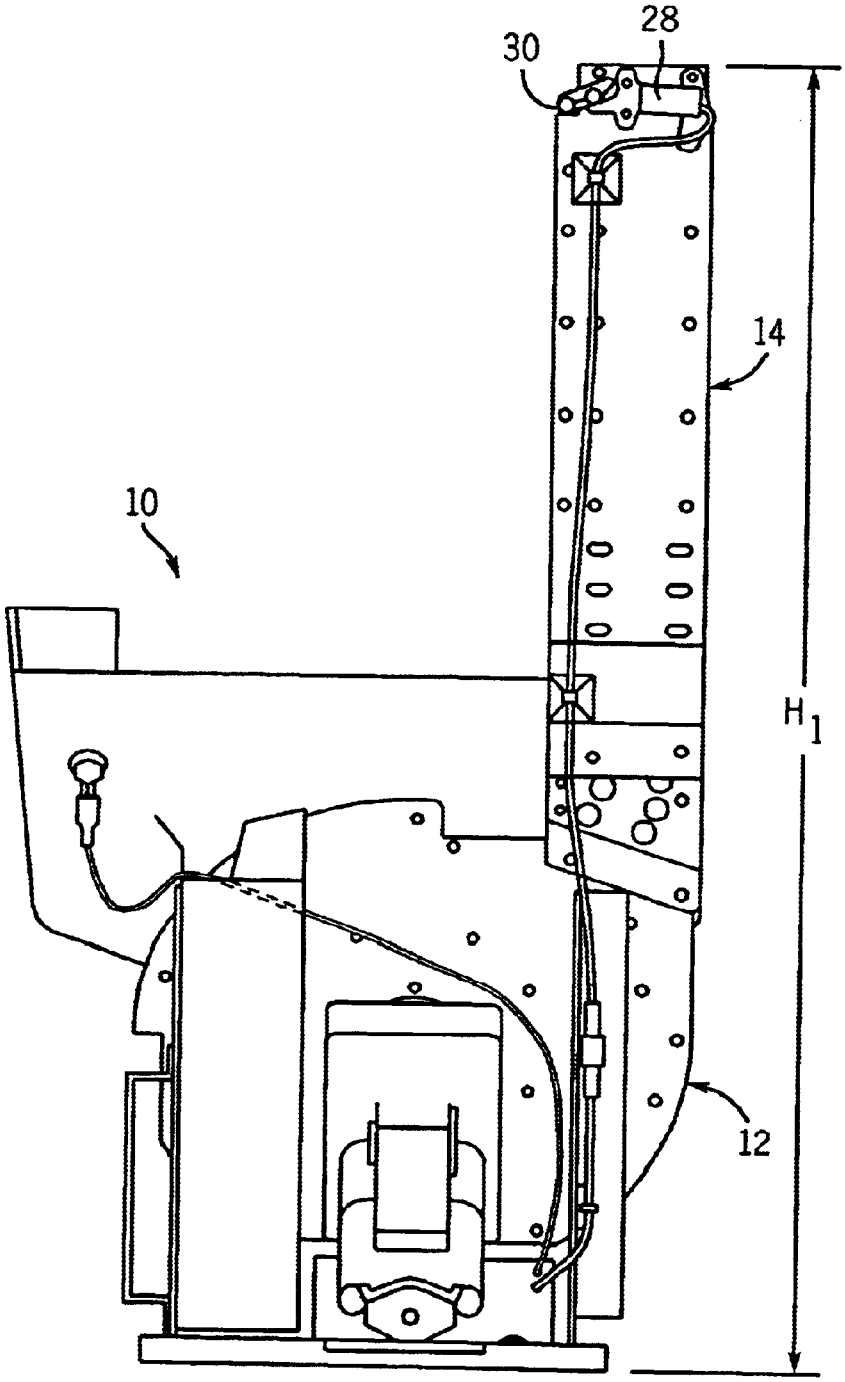
FIG. 2 is a side view of the coin handling device with the folding escalator in an unfolded position.
Figure 3:
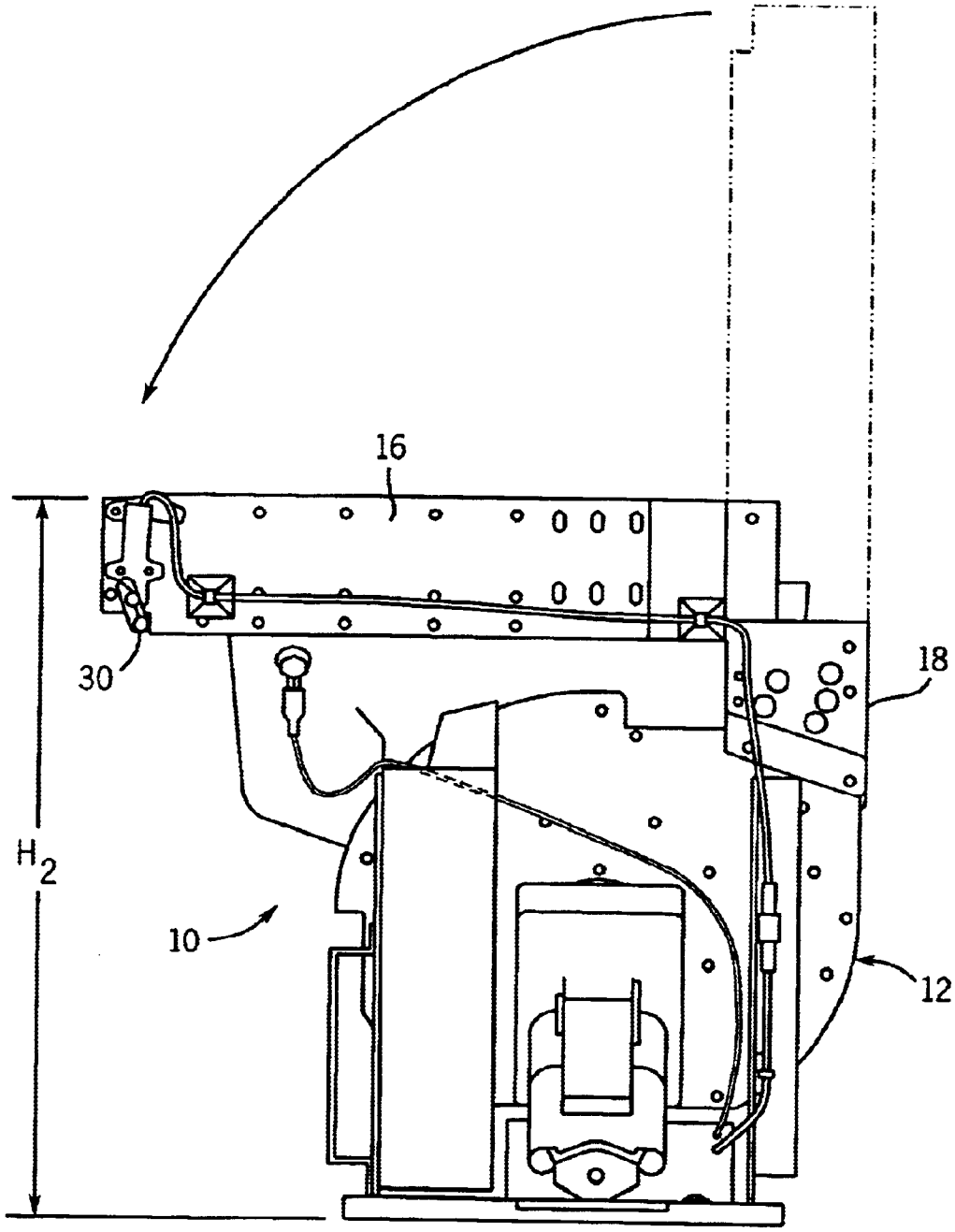
FIG. 3 is a side view of the coin handling device with the folding escalator in a folded position.

Turning now to the drawings, FIGS. 1, 2, and 3 depict a coin handling device 10 comprising a coin hopper 12 and a coin escalator 14 for receiving coins from the hopper 12. The escalator 14 successively receives coins from the hopper 12 and conveys them upwardly in a single file to a coin outlet of a gaming machine that houses the coin handling device 10. The coins are dispensed into a coin tray or bin via the coin outlet. The escalator 14 is connected to the hopper 12 and extends upwardly from the hopper 12. A substantial upper portion 16 of the escalator 14 is downwardly foldable toward the hopper 12 to reduce an overall height of the coin handling device 10. During normal use of the coin handling device 10, the escalator portion 16 is disposed in a generally vertical position as shown in FIG. 2 so that the coin handling device 10 has an overall height $H_1$. When, however, the coin handling device 10 must be removed from a gaming machine cabinet for servicing or replacement or installed into the cabinet, the escalator portion 16 is folded downward from the generally vertical position to a generally horizontal position shown FIG. 3 so that the overall height of the coin handling device 10 is reduced to $H_2$.

Figure 4:
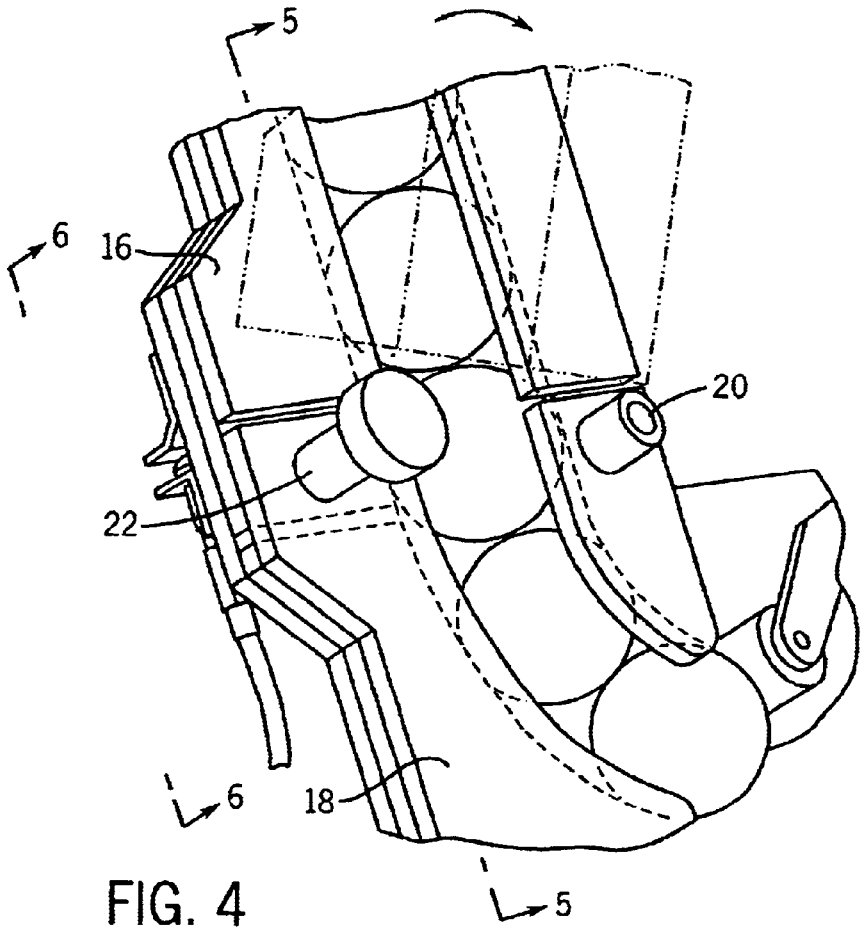
FIG. 4 is an enlarged perspective view of a pivot area of the folding escalator.
Figure 5:
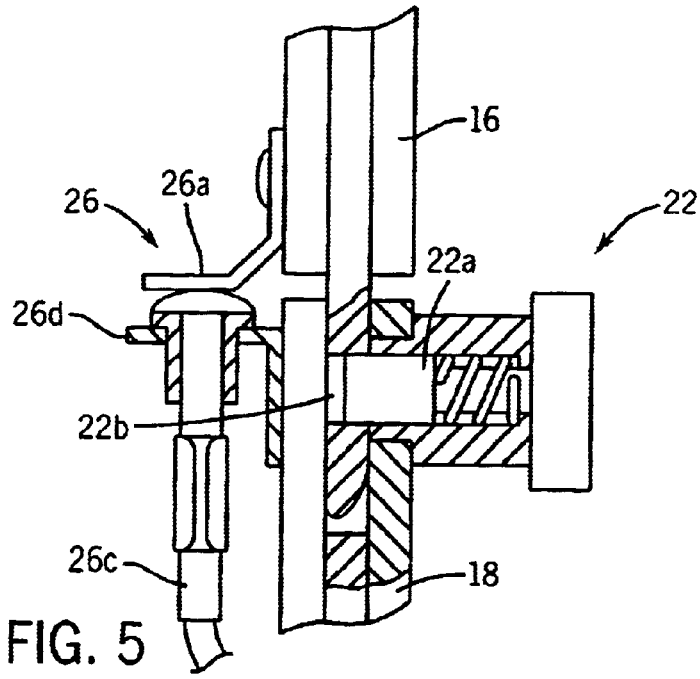
FIG. 5 is a sectional view taken generally along line 5—5 in FIG. 4.

Referring to FIGS. 4 and 5, the upper escalator portion 16 is connected to a remaining lower portion 18 of the escalator 14 by an inboard pivot 20 and an outboard latching mechanism 22. The inboard pivot 20 preferably includes a pin and a bearing. The outboard latching mechanism 22 preferably includes a spring-loaded latch pin 22*a* and associated aperture 22*b*. The latch pin 22*a* is mounted to the lower escalator portion 18, while the aperture 22*b* is formed in the upper escalator portion. During normal use of the coin handling device 10, the spring-loaded latch pin 22*a* engages with the aperture 22*b* to hold the escalator portion 16 in the vertical position. When, however, the coin handling device 10 must be removed from the cabinet for servicing or replacement, the latch pin 22*a* is released from the aperture 22*b* to allow the escalator portion 16 to be folded or pivoted about the inboard pivot 20 from the vertical position to the horizontal position. The escalator portion 16 is folded in an imaginary plane occupied by the escalator 14, the inboard pivot 20, and the outboard latching mechanism 22.

Figure 7:
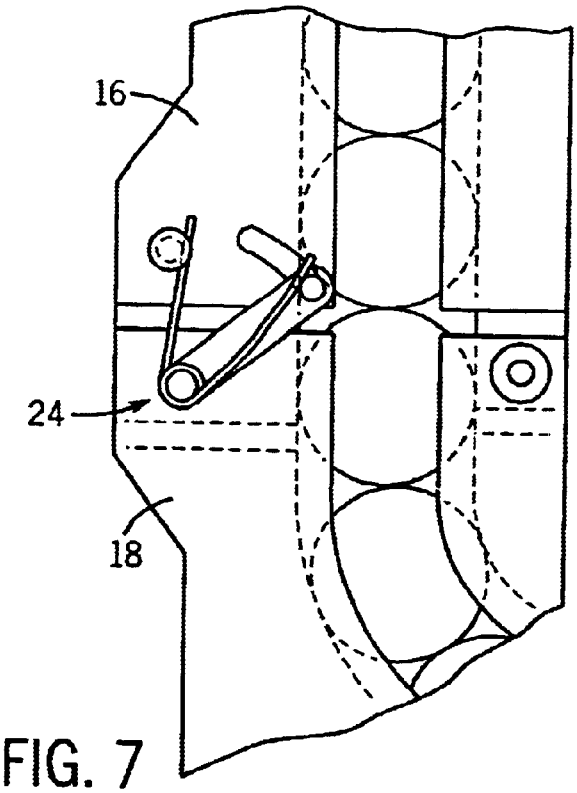
FIG. 7 is an enlarged front view of the pivot area of the folding escalator when outfitted with an optional spring-loaded arm.
Figure 8:
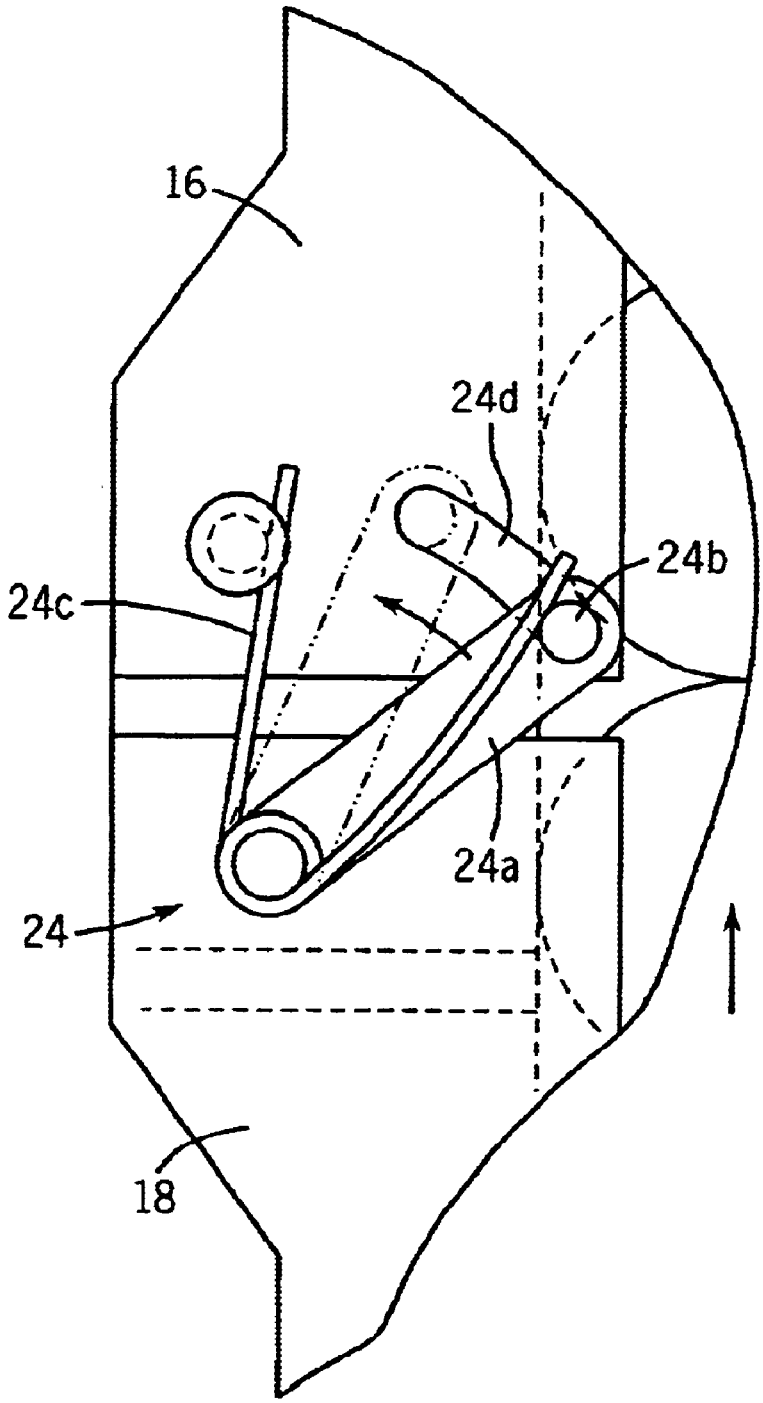
FIG. 8 is an enlarged front view of the optional spring-loaded arm.

Referring to FIGS. 7 and 8, the coin handling device 10 preferably includes a retention mechanism 24 for retaining any coins in the escalator portion 16 while it is folded. The retention mechanism 24 preferably includes a spring-loaded arm 24*a*, a pin 24*b*, a torsion spring 24*c*, and a curved slot 24*d*. The pin 24*b* is mounted to an end of the arm 24*a* and is movable through the curved slot 24*d* formed in the escalator portion 16. The arm 24*a* is biased in a clockwise direction by the torsion spring 24*c*. The retention mechanism 24 is always active—during normal use of the coin handling device 10 and while the escalator portion 16 is folded. As coins are conveyed upwardly through the escalator 14 and pass through the junction between the upper escalator portion 16 and the lower escalator portion 18, each coin pushes against the pin 24*b* and thereby forces the arm 24*a* and attached pin 24*b* to move counterclockwise against the bias of the torsion spring 24*c*. Once the coin passes through the junction, the arm 24*a* and attached pin 24*b* return clockwise to the home position, where the pin 24*b* now stops the coin from falling downward back through the junction. In an alternative embodiment, the retention mechanism 24 may be designed to be activated by the release of the latching mechanism 22 and deactivated by the latching of the latching mechanism 22, such that it is only active while the escalator portion 16 is folded.

As shown in FIGS. 2 and 3, another coin retention mechanism 30 is preferably disposed at the exit end of the escalator portion 16. The retention mechanism 30 includes a spring-loaded arm biased toward the illustrated position. The spring-loaded arm controls coins as they exit from the escalator portion 16 and, at the same time, prevents any coins in the escalator portion 16 from falling out via its exit end. As a coin exits from the escalator portion 16, the coin pushes past the spring-loaded arm which, in turn, triggers a coin counter 28.

Figure 6:
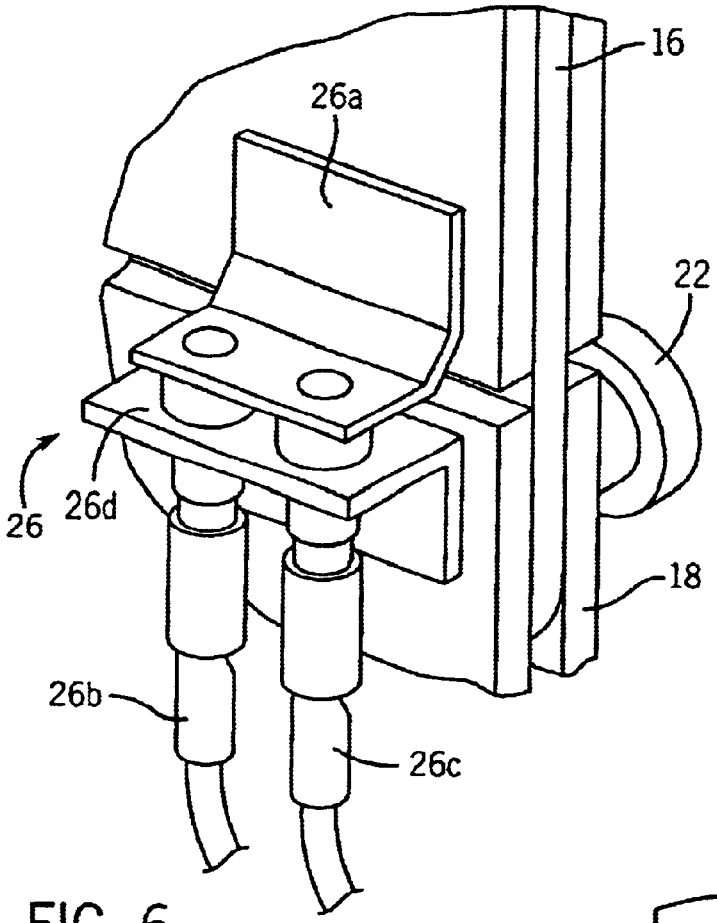
FIG. 6 is a sectional view taken generally along line 6—6 in FIG. 4.

Referring to FIGS. 5 and 6, the coin handling device 10 includes a continuity mechanism 26 for sensing whether or not the escalator portion 16 is folded. The continuity mechanism 26 may be an electrical, magnetic, proximity, or other type of sensor known in the art. In the illustrated embodiment, the continuity mechanism 26 is an electrical sensor formed by a conductive spring 26*a* and a pair of insulated electrical wires 26*b* and 26*c*. The conductive spring 26*a* is mounted to the upper escalator portion 16. The wires 26*b* and 26*c* terminate in respective conductive contacts mounted within an insulating plate 26*d*. The insulating plate 26*d* is mounted to the lower escalator portion 18. When the escalator portion 16 is not folded (i.e., vertical) toward the hopper 12 as in FIG. 2, the conductive spring 26*a* creates an electrical path between the wires 26*b* and 26*c*. When the escalator portion 16 is folded (i.e., horizontal) toward the hopper 12 as in FIG. 3, the electrical path between the wires 26*b* and 26*c* is broken because the conductive spring 26*b* no longer bridges the conductive contacts at the upper ends of the wires 26*b* and 26*c*.

The continuity mechanism 26 may be used to selectively disable the coin counter 28 (see FIG. 2) coupled to the mechanism. When the continuity mechanism 26 indicates that the escalator portion 16 is not folded toward the hopper 12 as in FIG. 2, the coin counter 28 counts any detected coins exiting from the coin escalator 14. However, when the continuity mechanism 26 indicates that the escalator portion 16 is folded toward the hopper 12 as in FIG. 3, the coin counter 28 is preferably disabled so that the counter does not inadvertently detect and count any coins that may shift in the escalator 14 during the folding process. By disabling the coin counter 28 during the folding process, the counter will not receive any superfluous signals from its coin sensor. In addition to disabling the coin counter 28, the hopper 12 is preferably disabled while the escalator portion 16 is folded toward the hopper 12.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A coin handling device comprising:

a hopper; and an escalator for receiving coins from the hopper, the escalator being connected to the hopper and extending upwardly from the hopper, at least a portion of the escalator being downwardly foldable toward the hopper to reduce an overall height of the coin handling device.

2. The device of claim 1, wherein the at least a portion of the escalator is foldable from a generally vertical position to a generally horizontal position.

3. The device of claim 1, wherein the at least a portion of the escalator is foldable about a pivot.

4. The device of claim 3, wherein the pivot includes a pin and a bearing.

5. The device of claim 3, wherein the at least a portion of the escalator is foldable in an imaginary plane occupied by the escalator and the pivot.

6. The device of claim 1, further including a retention mechanism for retaining any coins in the escalator.

7. The device of claim 6, wherein the retention mechanism includes a spring loaded arm.

8. The device of claim 6, wherein the at least a portion of the escalator is foldable from an upper position to a lower position, the retention mechanism being actuated while the at least a portion of the escalator is folded from the upper position and the lower position.

9. The device of claim 8, wherein the retention mechanism is also active while the at least a portion of the escalator is in the upper and lower positions.

10. The device of claim 1, further including means for retaining any coins in the escalator while the at least a portion of the escalator is folded toward the hopper.

11. The device of claim 1, wherein the at least a portion of the escalator is foldable from an upper position to a lower position, and further including a latching mechanism for latching the at least a portion of the escalator in the upper position and releasing the at least a portion of the escalator from the upper position.

12. The device of claim 11, wherein the latching mechanism includes a spring-loaded latch pin.

13. The device of claim 1, further including a continuity mechanism for indicating whether or not the at least a portion of the escalator is folded toward the hopper.

14. The device of claim 1, wherein the continuity mechanism is used to selectively disable a coin counter for detecting the coins conveyed through the escalator, the coin counter being disabled while the at least a portion of the escalator is folded toward the hopper.

15. The device of claim 1, wherein the at least a portion of the escalator is connected to a remainder of the escalator by an inboard pivot and an outboard latching mechanism, the at least a portion of the escalator being foldable about the inboard pivot in response to release of the outboard latching mechanism.

16. A method of reducing an overall height of a coin handling device, the coin handling device including a hopper and an escalator for receiving coins from the hopper, the escalator being connected to the hopper and extending upwardly from the hopper, at least a portion of the escalator being downwardly foldable toward the hopper, the method comprising folding the at least a portion of the escalator downward toward the hopper to reduce an overall height of the coin handling device.

17. The method of claim 16, wherein the folding step includes folding the at least a portion of the escalator from a generally vertical position to a generally horizontal position.

18. The method of claim 16, wherein the folding step includes folding the at least a portion of the escalator about a pivot.

19. The method of claim 18, wherein the pivot includes a pin and a bearing.

20. The method of claim 18, wherein the folding step includes folding the at least a portion of the escalator in an imaginary plane occupied by the escalator and the pivot.

21. The method of claim 16, further including retaining any coins in the escalator.

22. The method of claim 21, wherein the retaining step occurs during the folding step.

23. The method of claim 22, wherein the retaining step also occurs prior to and after the folding step.

24. The method of claim 16, wherein the folding step includes folding the at least a portion of the escalator from an upper position to a lower position, and further including, prior to the folding step, latching the at least a portion of the escalator in the upper position and releasing the at least a portion of the escalator from the upper position.

25. The method of claim 16, wherein the coin handling device includes a coin sensor for detecting the coins conveyed through the escalator, and further including disabling the coin sensor during the folding step.

26. The method of claim 16, further including disabling the hopper during the folding step.

27. The method of claim 16, wherein the at least a portion of the escalator is connected to a remainder of the escalator by an inboard pivot and an outboard latching mechanism, and wherein the folding step includes folding the at least a portion of the escalator about the inboard pivot in response to releasing the outboard latching mechanism.

28. The method of claim 16, further including providing a continuity mechanism for indicating whether or not the at least a portion of the escalator is folded toward the hopper.

* * * * *